US007022015B2

(12) United States Patent
Mostashari

(10) Patent No.: US 7,022,015 B2
(45) Date of Patent: Apr. 4, 2006

(54) NO BUST 21 (BLACKJACK)

(76) Inventor: Moe Mostashari, 17800 E. Colima Rd. #770, Roland Heights, CA (US) 91748

( * ) Notice: Subject to any disclaimer, the term of this patent is extended or adjusted under 35 U.S.C. 154(b) by 387 days.

(21) Appl. No.: 10/050,877

(22) Filed: Jan. 18, 2002

(65) Prior Publication Data

US 2003/0139211 A1 Jul. 24, 2003

Related U.S. Application Data

(63) Continuation-in-part of application No. 09/492,395, filed on Jan. 27, 2000, now Pat. No. 6,170,828.

(51) Int. Cl.
*A63F 13/00* (2006.01)

(52) U.S. Cl. ..... 463/12; 273/292

(58) Field of Classification Search ..... 463/12–16; 273/292, 274, 139

See application file for complete search history.

(56) References Cited

U.S. PATENT DOCUMENTS

| | | | | | |
|---|---|---|---|---|---|
| 5,265,877 | A | * | 11/1993 | Boylan et al. | 273/139 |
| 5,275,417 | A | * | 1/1994 | Seymour | 273/330 |
| 5,810,360 | A | * | 9/1998 | Srichayaporn | 273/292 |
| 5,823,536 | A | * | 10/1998 | Flasch | 273/292 |
| 6,027,118 | A | * | 2/2000 | Aramapakul et al. | 273/274 |
| 6,422,565 | B1 | * | 7/2002 | Daines | 273/292 |
| 6,536,769 | B1 | * | 3/2003 | Palacios et al. | 273/292 |
| 6,612,580 | B1 | * | 9/2003 | Weldon | 273/292 |

* cited by examiner

*Primary Examiner*—John M. Hotaling, II
(74) *Attorney, Agent, or Firm*—Robert Ryan Morishita; Morishita Law Firm, LLC

(57) ABSTRACT

In a NO BUST 21 (BLACKJACK) game, a player has an option of having a dealer replace a draw card that causes the player's hand to bust. When a hit does not cause the player's hand to bust, the player has a surrender option. When the player's hand has a total point value less than "21", the player has an option of doubling down.

6 Claims, 6 Drawing Sheets

NO BUST 21 (BLACKJACK)

This is a continuation in part pf application Ser. No. 09/492,395, filed 27 Jan. 2000, now U.S. Pat. No. 6,170,828.

BACKGROUND OF THE INVENTION

1. Field of Invention

This invention is in the general field of casino gaming and, more particularly, is a variation of the game of blackjack.

2. Description of the Prior Art

Blackjack is a game played at a semicircular table with seven player stations equally spaced on the table's top near an arcuate edge thereof. A player station has an imprint of a circle. A player at the station places cheques representative of a wager within the circle.

A dealer is positioned near a straight edge of the table. The dealer faces the player.

Blackjack is played with one or more standard decks of cards. An ace dealt to a player has a point value of either "1" or "11" at the election of the player; a face card (jack, queen or king) has a point value of "10" and each of the remaining cards ("2" through "10") have a point value equal to what is alternatively referred to as a "pip" value or a number value. Point values of cards held by the player are added together to obtain a total point value. A total point value of cards held by the dealer is obtained in a similar manner.

After the cheques are placed within the circle, the cards are shuffled and the player and the dealer are each dealt a hand comprised of two cards. The two cards of the player's hand are dealt face-up. A first card of the dealer's hand is dealt face-down. A second card of the dealer's hand is dealt face-up.

Whenever the dealer's face-up card is either an ace or has a point value of "10", the dealer ascertains the point value of the face-down card without revealing it to the player unless the dealer's two dealt cards have a total point value is "21". When the dealer's two dealt cards have the total point value of "21", the dealer is said to have blackjack whereupon the dealer turns the face-down card face up. Similarly, when the player's two dealt cards have the total point value of "21", the player is said to have blackjack.

When the dealer has blackjack, the dealer wins the wager with two exceptions. A first exception occurs when the dealer's face up card is an ace and the player makes what is known as an insurance bet which is typically equal to one half, or less, of the wager. When the dealer does not have blackjack, the player loses the insurance bet. Conversely, when the dealer has blackjack, the player wins the insurance bet. When the player wins, cheques representative of the wager and two and one half times the insurance bet are returned to the player.

The second exception occurs when the player has blackjack whereupon the cheques representative of the wager are returned to the player. The second exception is an example of when the player's hand and the dealer's hand have the same total point value and is referred to as a push.

When the player has blackjack and the dealer does not, the player wins the wager. When neither the dealer nor the player have blackjack, the player has four options.

A first option is to have the player's hand augmented by what is called a draw card (referred to as a "hit"). The player may have successive hits until the player total point value exceeds "21". When the total point value of a hand exceeds "21" it is said to bust. The player loses the wager when the player's hand busts. Therefore, busting is a sudden, catastrophic termination of play for the player.

A second option is not to have the player's hand augmented by the draw card (referred to as a "stand"). The player may stand at any time that the player's hand has not busted.

A third option, referred to as doubling down, permits the player to double the wager and receive one additional card.

A fourth option is available when the player's hand is comprised of two cards that are a pair, such as a pair of queens, for example. The player may split the pair into first and second hands. An additional card is dealt to the player's first hand and to the player's second hand. The player's first and second hands are each played as described hereinbefore.

The decision to hit or stand is made with an objective of causing the total point value of the payer's hand to be closer to "21" than the total point value of the dealer's hand. It should be understood that central factors in making the decision are the dealer's face-up card and the total point value of the player's hand.

After the player stands, the dealer's face-down card is turned face-up, whereby both cards of the dealer's hand are face-up. When the total point value of the dealer's hand is less than "17" the dealer must hit until the total point value of the dealer's hand is at least "17". When a hit causes the dealer's hand to bust and the player's hand has not busted, the player wins the wager.

It should be understood that when an exemplary hand includes an ace and a six, for example, it is referred to as a soft "17" because the ace causes the exemplary hand to have alternative point values of "7" and "17". Usually, the dealer's hand cannot be hit when it is the soft "17".

When neither the player's hand nor the dealer's hand busts and the total point value of the dealer's hand exceeds the total point value of the player's hand, the dealer wins and vice versa. When there is a push, there is no winner; the cheques representative of the wager are returned to the player.

In NO BUST 21 (BLACKJACK), two or more jokers are added to a standard deck of cards. A natural is a hand that consists of two jokers. The natural outranks all other hands. A hand has a total point value of "21" when it includes a joker. The player may hit, double-down, split a pair or surrender when the dealer's face-up card is not a joker.

When a dealer's hand has a total point value that is a soft "17" or less, a dealer must take a hit to acquire a final dealer's hand that has a point value of "17" (not a soft "17") or greater.

When the player's and the dealer's final hands have total point values that are greater than "21" and the total point value of the player's hand is less than or equal to the total point value of the dealer's hand, it is regarded as a push. When the total point values are each greater than "21", with the point value of the dealer's hand being closer to "21" than the point value of the player's hand, the player loses. NO BUST 21 (BLACKJACK) is the subject matter of U.S. Pat. No. 6,170,828.

SUMMARY OF THE INVENTION

According to a first aspect of the present invention, in an improved game of NO BUST 21 (BLACKJACK), a player has the following options:

1. when a draw card causes a player's hand to bust, the player has an option of having the dealer replace the draw card;

2. after a hit that does not cause the player's hand to bust, the player has a surrender option;

3. when a player's hand has a total point value that is less than "21", the player has an option of doubling down.

Other objects, features, and advantages of the invention should be apparent from the following description of the preferred embodiment thereof as illustrated in the accompanying drawing.

DESCRIPTION OF THE PREFERRED EMBODIMENT

NO BUST 21 (BLACKJACK) is a game that is played with one or more standard decks of cards, each of which is augmented by two jokers. As in most blackjack games, cheques representative of an initial wager are posted by a player before cards are dealt. Thereafter, the player is initially dealt two cards face-up. A dealer is dealt one card face up and one card face-down.

When the player's hand does not have a total point value of "21" and is not a natural, the player may hit whereby the player's hand is augmented by an initial draw card. In accordance with a first improvement, when a particular draw card causes the total point value of the player's hand to exceed "21", the player has a second chance hit option of forfeiting half of the wager and receiving a second chance draw card as a replacement for the particular draw card.

Figure 1:
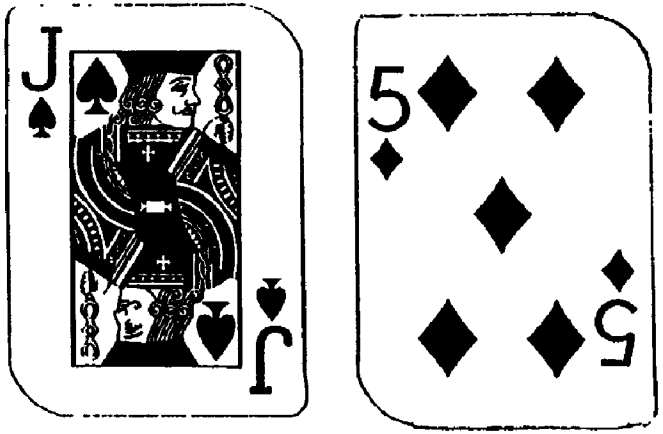
FIGS. 1–3 are an illustration of a second chance hit option.

As shown in FIG. 1, as an example of the second card hit option, the player's initial two face-up cards are a J♠ and a 5♢ whereby the player's hand has a total point value of "15".

Figure 2:
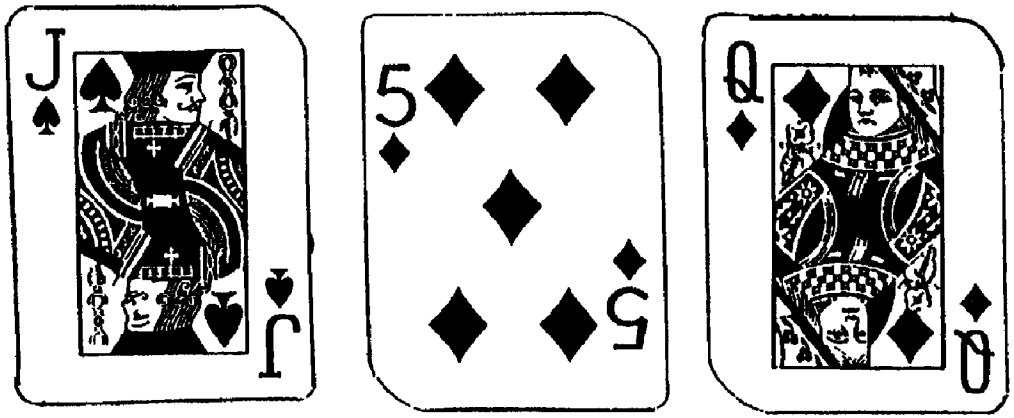

As shown in FIG. 2, the player decides to hit, thereby causing the player's hand to be augmented by the Q♢ which is a draw card that causes the total point value of the player's hand to be "25" whereby the total point value of the player's hand exceeds "21".

Figure 3:
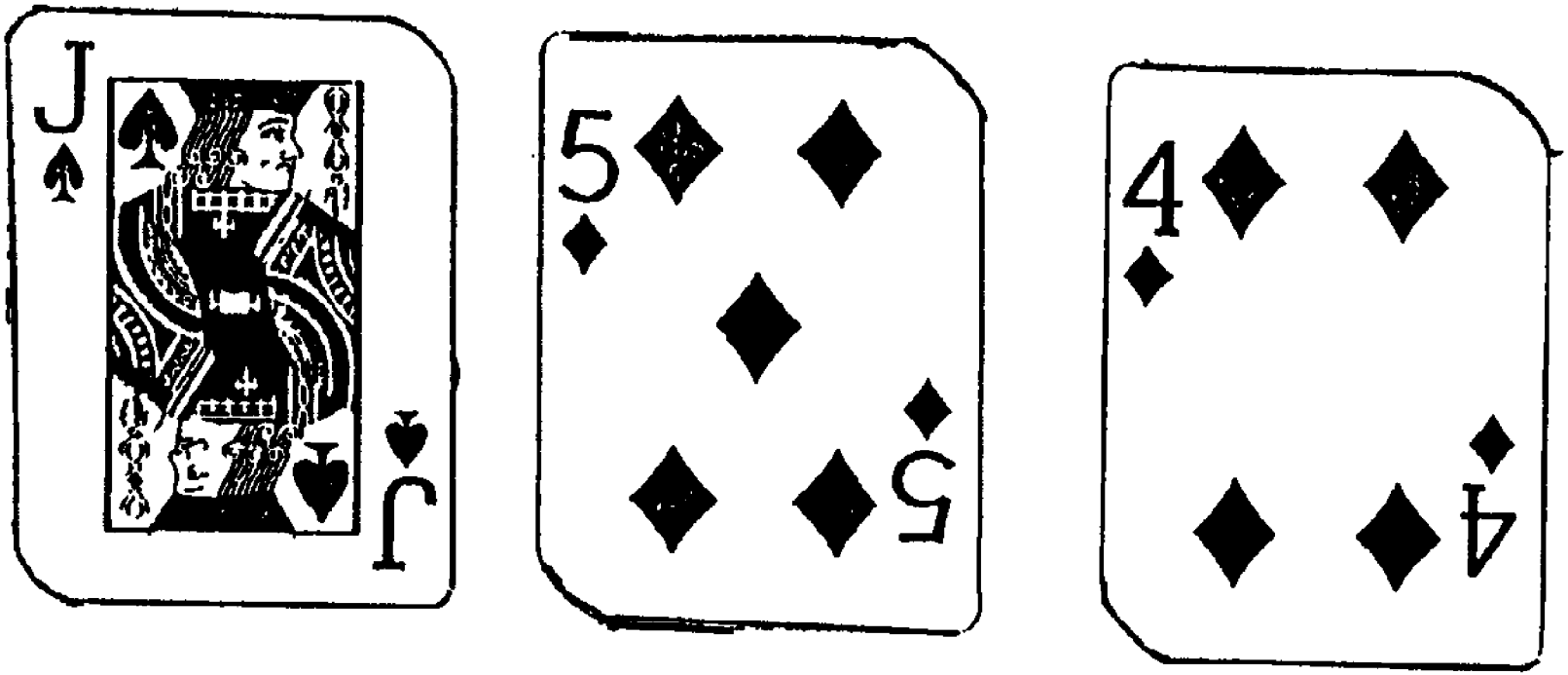

As shown in FIG. 3, upon surrendering half of the initial wager, the player is dealt a second chance draw card, the 4♢, which replaces the Q♢ whereby the player's final hand includes the J♠, the 5♢ and the 4♢ for a total point count value of "19". Preferably, for each of the player's hands there is only one second chance hit option. The player cannot call for an additional hit after exercising the second chance hit option.

In addition to having an option of surrendering prior to receiving a draw card as taught in the prior art, in accordance with a second improvement, the player has an expanded surrender option of forfeiting half of the initial wager and surrendering either before or after the player receives a draw card.

Figure 4:
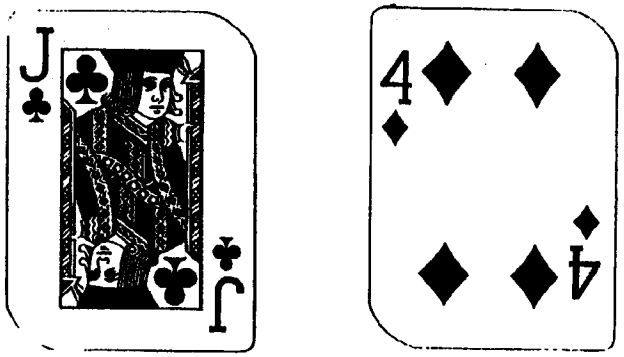
FIGS. 4 and 5 are an illustration of an expanded surrender option.
Figure 5:
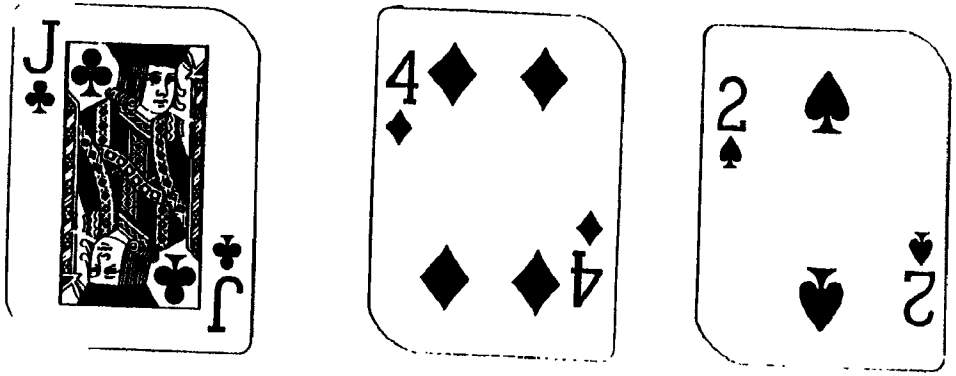

As shown in FIGS. 4 and 5, as an example of the expanded surrender option, the player's initial two face-up cards are a J♣ and a 4♢ whereby the player's hand has a total point value of "14" (FIG. 4). The player has an option of forfeiting half of the initial wager and surrendering. In accordance with this example of the expanded surrender option, the player decides to hit and has his hand augmented by a 2♠ whereby the player's hand has a total point value of 16 (FIG. 5). The player again has the option of forfeiting half of the wager and surrendering.

In accordance with a third improvement, the player has an option of making a double down wager and doubling down with a hand that includes two or more cards, including hands that result from a split. Additionally, after doubling down and receiving a double down draw card, the player has an option of forfeiting half of the double down wager in exchange for one or more hits.

Figure 6:
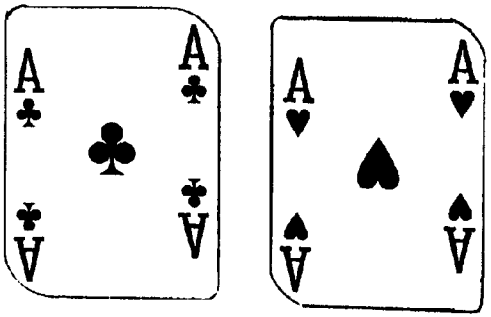
FIGS. 6–12 are an illustration of aspects of a double down option.
Figure 7:
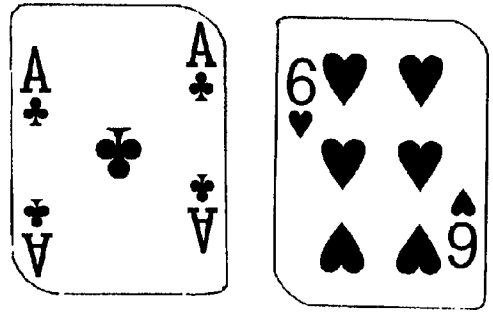
Figure 8:
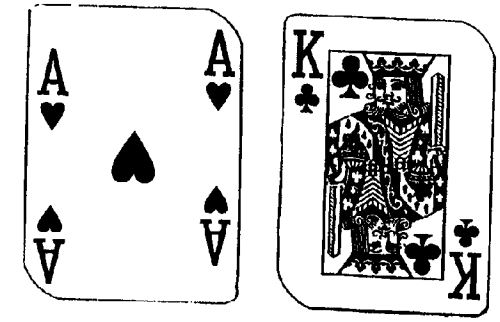

As shown in FIGS. 6–8, as an example of one aspect of the third improvement, the player's initial two face-up cards are an A♣ and an A♡ (FIG. 6). Since the player has a pair, the player can exercise an option to split. A condition for splitting is doubling the initial wager. An amount equal to the initial wager is wagered on a first split hand. Similarly, an amount equal to the initial wager is wagered on a second split hand.

After the player doubles the initial wager, a 6♡ is dealt which augments the A♣ to form the first split hand (FIG. 7). A K♣ is dealt which augments the A♡ to form the second split hand (FIG. 8).

The player has an option of doubling down on the first split hand by making a first split hand double down wager equal to the initial wager.

Figure 9:
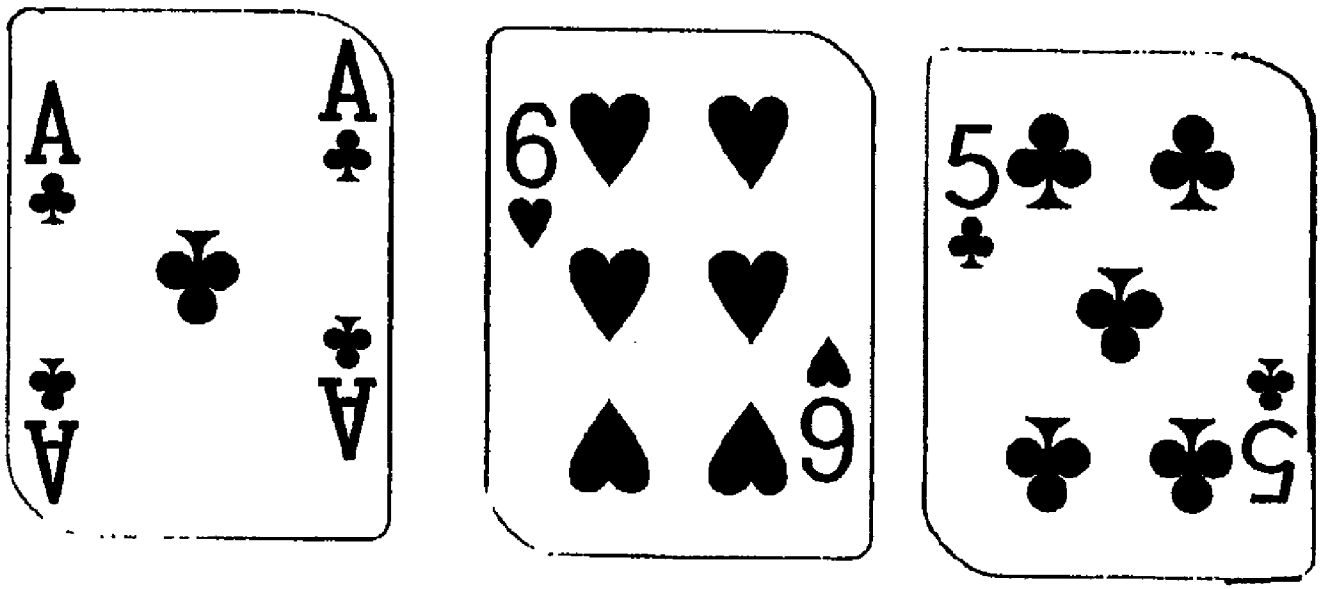

As shown in FIG. 9, after the player exercises the option to double down on the first split hand, the first split hand is augmented by a double down draw card which is a 5♣ whereby the first split hand has a total point value of "12". The player has an option of forfeiting half of the first split hand double down wager and surrendering.

Figure 10:
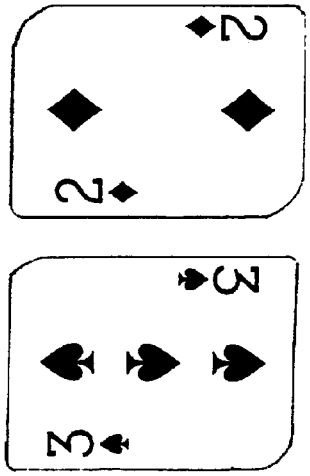

As shown in FIG. 10, in an example of other aspects of the third improvement, the players initial two face-up cards are a 3♠ and a 2♢ whereby the player's hand has a total point value of "5". Thereafter, the player makes a decision to hit.

Figure 11:
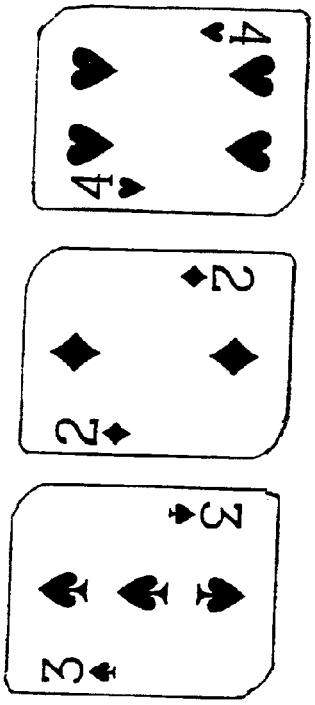

As shown in FIG. 11, as a result of a hit, the 3♠ and a 2♢ are augmented by the 4♡ whereby the player's hand has a total point value of "9". The player exercises the double down option by making a double down wager.

Figure 12:
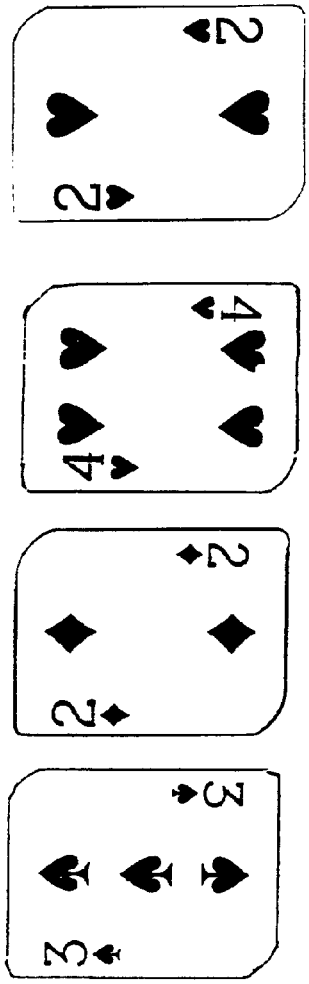

As shown in FIG. 12, in response to making the double down wager, the player is dealt a double down draw card which is a 2♡ that augments the 3♠, 2♢ and 4♡ whereby the player's hand has a total point value of "11". Thereafter the player exercises an option to forfeit half of the double down wager and receive a hit as described hereinbefore.

While the invention has been particularly shown and described with reference to a preferred embodiment, it should be understood by those skilled in the art that changes in form and detail may be made therein without departing from the spirit and scope of the invention.

I claim:

1. In a method of playing a game of NO BUST 21, BLACKJACK, with a standard deck of cards to which two or more jokers added where;

a natural hand consisting of two jokers outranks all other hands;

a hand has a total point value of "21" when it includes a joker;

a player has an option of hitting or splitting a pair when the dealer's face-up card is not a joker;

the dealer must hit to acquire a final hand that has a total point value that is "17", not a soft 17, or greater;

when a final hand of the player and the final hand of the dealer have total point values that are greater than "21"

and the total point value of the player's final hand is less than or equal to the total point value of the dealer's final hand, it is regarded as a push, when the total point values are each greater than "21", with the dealer point value being closer to "21" than the player point value, the player loses;

the improvement comprising the step of giving the player a second chance hit option of having the dealer replace a draw card that causes the player's hand to bust.

2. In the method of claim 1 wherein the player cannot call for an additional hit after having exercised said second chance hit option.

3. In the method of claim 1 comprising the additional step of giving the player a surrender option after a hit that does not cause the player to bust.

4. In the method of claim 2 comprising the additional step of giving the player an option of doubling down on any hand that has a total point value less than "21".

5. In the method of claim 4, the additional step of giving the player an option of forfeiting a portion of a double down wager in exchange for one or more hits.

6. In the method of claim 4 wherein said player has an option of doubling down on a hand resulting from a split.

* * * * *